US008980521B2

(12) United States Patent
Aoki et al.

(10) Patent No.: US 8,980,521 B2
(45) Date of Patent: Mar. 17, 2015

(54) METHOD OF PRODUCING TONER

(75) Inventors: Kenji Aoki, Mishima (JP); Shuntaro Watanabe, Hadano (JP); Takaaki Kaya, Suntou-gun (JP); Ayako Okamoto, Wako (JP); Tetsuya Kinumatsu, Numazu (JP); Atsushi Tani, Suntou-gun (JP); Takashige Kasuya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/990,740

(22) PCT Filed: Nov. 21, 2011

(86) PCT No.: PCT/JP2011/077438

§ 371 (c)(1),
(2), (4) Date: May 30, 2013

(87) PCT Pub. No.: WO2012/073911

PCT Pub. Date: Jun. 7, 2012

(65) Prior Publication Data

US 2013/0266897 A1 Oct. 10, 2013

(30) Foreign Application Priority Data

Dec. 2, 2010 (JP) ..... 2010-269739

(51) Int. Cl.
*G03G 9/087* (2006.01)
*G03G 9/08* (2006.01)

(52) U.S. Cl.
CPC ..... *G03G 9/0804* (2013.01); *G03G 9/08755* (2013.01); *G03G 9/08764* (2013.01); *G03G 9/08788* (2013.01); *G03G 9/08797* (2013.01)
USPC ..... 430/137.14; 430/109.4

(58) Field of Classification Search
USPC ..... 430/137.14, 109.4
See application file for complete search history.

(56) References Cited

U.S. PATENT DOCUMENTS

| | | | | |
|---|---|---|---|---|
| 2007/0048647 | A1 | 3/2007 | Daimon | |
| 2008/0057430 | A1 | 3/2008 | Takahashi | |
| 2012/0052431 | A1 * | 3/2012 | Hozumi et al. | 430/105 |

FOREIGN PATENT DOCUMENTS

| | | | |
|---|---|---|---|
| CN | 101393403 | A | 3/2009 |
| CN | 101598912 | A | 12/2009 |
| JP | 2003-131417 | A | 5/2003 |
| JP | 2004-191927 | A | 7/2004 |
| JP | 2005-234046 | A | 9/2005 |
| JP | 2006-084843 | A | 3/2006 |
| JP | 2006-276074 | A | 10/2006 |
| JP | 2006-276855 | A | 10/2006 |
| JP | 2007-147927 | A | 6/2007 |
| JP | 2010-204358 | A1 * | 9/2010 |

OTHER PUBLICATIONS

Japanese Patent Office AIPN machine-assisted English-language translation of JP 2010-204358 (pub. Sep. 2010).*

* cited by examiner

*Primary Examiner* — Janis L Dote
(74) *Attorney, Agent, or Firm* — Canon U.S.A. Inc, IP Division

(57) ABSTRACT

The present invention provides a toner excellent in low-temperature fixability and also excellent in heat-resistant storage property, offset resistance, and durability. In a process for producing a toner containing toner particles by emulsion aggregation, each toner particle includes a binder resin of which a main component is a block polymer having a crystal structure, a colorant, and a release agent; the binder resin includes polyester as a main component; the rate of a portion capable of forming a crystal structure to the binder resin is 50 to 80 mass %; a peak temperature Tp of a maximum endothermic peak attributed to the binder resin is 50 to 80° C. in endothermic amount measurement of the toner with a differential scanning calorimeter (DSC); and fused particles are heated at a heating temperature t (° C.) satisfying $Tp'-15.0 \leq t \leq Tp'-5.0$ for at least 0.5 hr.

4 Claims, No Drawings

METHOD OF PRODUCING TONER

TECHNICAL FIELD

The present invention relates to a method of producing a toner that is used in a recoding method such as electrophotography, an electrostatic recording method, or a toner-jetting system. More specifically, the present invention relates to a method of producing a toner by emulsion aggregation, wherein the toner is used in a copier, printer, or facsimile machine that produces a fixed image by forming a toner image on an electrostatic latent image support member and then transferring the toner image onto a transfer material and fixing the image with heating and pressurizing.

BACKGROUND ART

Recently, a method of producing a toner (hereinafter also referred to as aggregation toner) by emulsion aggregation has been proposed as a method that can purposely control the surface shape of the toner. In the emulsion aggregation, a toner is usually produced by aggregating fine particles of raw materials having an average particle diameter of 1 μm or less. Therefore, in principle, a toner having a small diameter can be efficiently produced. In addition, a fine textured structure can be easily formed on the surface.

At the same time, recently, saving of energy is a technical issue also in electrophotographic apparatuses, and a large reduction in quantity of heat during fixation of a toner has been being investigated. Accordingly, demands for toners that can be fixed with lower energies, i.e., toners having "low-temperature fixabilities" are increasing.

As a method of enabling fixation of a toner at low temperature, for example, a reduction in glass transition point (hereinafter also referred to as Tg) of a binder resin is performed. However, a reduction in Tg leads to deterioration in heat-resistant storage property of the toner. Therefore, it is difficult to fix a toner at lower temperature.

In order to simultaneously improve the low-temperature fixability and the heat-resistant storage property of a toner, a method of using a crystalline polyester as a binder resin of the toner has been investigated. The crystalline polyester has molecular chains regularly arranged and thereby does not show a defined Tg and has a property not being softened until the melting point. Furthermore, the crystalline polyester sharply melts at the melting point and sharply reduces its viscosity accompanied thereby, that is, the crystalline polyester has a so-called sharp melting property. Accordingly, the crystalline polyester attracts attention as a material that can improve both the low-temperature fixability and the heat-resistant storage property.

PTL 1 proposes a toner produced by a pulverization method using a mixture of a crystalline polyester and a non-crystalline polyester as a binder resin. More specifically, a mixture of a crystalline polyester and a cycloolefin-based copolymer resin is used as a binder resin. However, in this technology, since the ratio of an amorphous material is high, the fixation of the toner tends to be influenced by the Tg of the amorphous material, and therefore the sharp melting property of the crystalline polyester cannot be sufficiently utilized.

Accordingly, technologies of aggregation toners, in which the main component of a binder resin is crystalline polyester and the sharp melting properties thereof are sufficiently exhibited, have been proposed (see PTLs 2, 3, and 4). However, though these toners are excellent in low-temperature fixability, the elasticity at high temperature is insufficient to cause a problem of easily causing high-temperature offset during fixation, and further improvement is demanded. Furthermore, it was revealed that detachment or cracking of toners are caused by printing of a large number of sheets.

In addition, an aggregation toner containing a small amount of a block polymer, in which bound to a crystalline polyester and an amorphous portion are linked to each other, as a binder resin of the toner has been proposed (see PTL 5). In this technology, the fixing property is improved by forming a good dispersion state of the three components: the crystalline polyester, block polymer, and amorphous resin. However, also in this technology, the improvement in durability of a toner in printing of a large number of sheets is restricted, and there is a demand for further improvement.

CITATION LIST

Patent Literature

PTL 1 Japanese Patent Laid-Open No. 2006-276074
PTL 2 Japanese Patent Laid-Open No. 2004-191927
PTL 3 Japanese Patent Laid-Open No. 2005-234046
PTL 4 Japanese Patent Laid-Open No. 2006-084843
PTL 5 Japanese Patent Laid-Open No. 2007-147927

SUMMARY OF INVENTION

The present invention has been made from a consideration of these problems and provides a method of producing a toner that is excellent in low-temperature fixability and also excellent in heat-resistant storage property, offset resistance, and toner durability in printing of a large number of sheets by producing toner particles by emulsion aggregation.

Solution to Problem

The present invention provides a process for producing a toner containing toner particles by emulsion aggregation, and the process includes an aggregation step of preparing aggregation particles by aggregating resin particles, colorant particles, and wax particles in a state dispersed in an aqueous medium and a fusion step of fusing the aggregation particles to form fused particles. Each toner particle includes a binder resin of which a main component is a block polymer having a crystal structure, a colorant, and a release agent; the binder resin includes polyester as a main component; the rate of a portion capable of forming a crystal structure to the binder resin is 50 mass % or more and 80 mass % or less; the peak temperature Tp of the maximum endothermic peak attributed to the binder resin is 50° C. or more and 80° C. or less in endothermic amount measurement of the toner with a differential scanning calorimeter (DSC); and the process further comprises heating the fused particles at a heating temperature t (° C.) satisfying the following expression (1):

$$Tp'-15.0 \leq t \leq Tp'-5.0 \quad (1)$$

(in the expression, Tp' represents the peak temperature of the maximum endothermic peak of the block polymer in the endothermic amount measurement with a DSC) for at least 0.5 hr.

Advantageous Effects of Invention

According to the present invention, it is possible to produce an aggregation toner that is excellent in low-temperature fixability and is also excellent in heat-resistant storage property, offset resistance, and also toner durability in printing of a large number of sheets.

DESCRIPTION OF EMBODIMENTS

The process of the present invention is a process of producing a toner including toner particles, each of which contains a binder resin of which main component is polyester, a colorant, and a release agent, prepared by emulsion aggregation.

The binder resin of the toner in the producing method of the present invention contains polyester as a main component. Herein, the term "main component" means that the component occupies 50 mass % or more of the total mass of the binder resin. The binder resin including polyester as a main component has a large amount of portions that can form crystal structures, and the portions that can form crystal structures are constituted of crystalline polyester.

In the binder resin including polyester as a main component in the producing method of the present invention, a block polymer having a crystal structure is the main component. The block polymer can be a block polymer in which a portion capable of forming a crystal structure and a portion not forming a crystal structure are chemically linked to each other.

The block polymer is a polymer including polymers bound to each other by a covalent bond in one molecule. Herein, the term "portion capable of forming a crystal structure" is a portion that shows crystallinity by gathering a large number thereof to be regularly arranged and refers to a crystalline polymer chain. Herein, the portion is a crystalline polyester chain.

The portion not forming a crystal structure is a portion that forms a random structure without being regularly arranged even if a large number thereof are gathered and refers to an amorphous polymer.

Herein, the term "crystalline polyester" denotes a structure in which the molecular chains of polyester are regularly arranged. Such polyester shows a clear melting point peak in measurement of endothermic amount using a differential scanning calorimeter (DSC).

The above-described block polymer forms fine domains in a toner. As a result, the sharp melting property of the crystalline polyester is exhibited by the entire toner, and a low-temperature fixing effect is effectively achieved. In addition, by the fine domain structure, suitable elasticity can be maintained even in the fixation temperature region after the sharp melting to provide a toner excellent in hot offset resistance. Furthermore, by using a binder resin including the block polymer as the main component, a strong network structure is formed by the entire toner even if the emulsion aggregation toner has a crystalline polyester portion. Accordingly, a stable image not having cracking and detachment of the toner can be provided even under conditions of being applied with mechanical shearing such as printing of a large number of sheets.

The binder resin may be the block polymer alone or may be a mixture with another resin. The rate of the block polymer to the binder resin can be 70 mass % or more, such as 85 mass % or more. The resin that is used together with the block polymer may be a crystalline resin or an amorphous resin. When such a resin is a crystalline resin, the resin is included in the portion capable of forming a crystal structure.

The block polymer of a crystalline polyester (A) and an amorphous polymer (B) can show the above-described effects in any form of an AB-type diblock polymer, an ABA-type triblock polymer, a BAB-type triblock polymer, and a multiblock polymer having repeating ABAB structures.

In the toner of the present invention, a binder resin having the portion capable of forming a crystal structure in a rate of 50 mass % or more and 80 mass % or less is used. In this range, the sharp melting property due to the crystallinity of the portion is effectively expressed. If the rate of the portion capable of forming a crystal structure to the binder resin is less than 50 mass %, the sharp melting property is not effectively expressed and is influenced by the Tg of the amorphous portion. In addition, the crystalline domains in the toner particles are reduced in size to make it further difficult to express the sharp melting property. As a result, the low-temperature fixability is deteriorated. The rate of the portion capable of forming a crystal structure to the binder resin can be 60 mass % or more. If the rate is higher than 80 mass %, the rate of the portion capable of forming a crystal structure is too high, which makes maintenance of the elasticity in a high-temperature region impossible. As a result, the hot offset resistance is deteriorated.

In the toner prepared by the producing method of the present invention, the peak temperature (Tp) of the maximum endothermic peak attributed to the binder resin is 50° C. or more and 80° C. or less in the endothermic amount measurement with a differential scanning calorimeter (DSC). The maximum endothermic peak can be attributed to the crystalline polyester.

A peak temperature of the maximum endothermic peak being lower than 50° C. is advantageous for the low-temperature fixability, but the heat-resistant storage property is significantly decreased. Therefore, the peak temperature is preferably 55° C. or more. A peak temperature of the maximum endothermic peak being higher than 80° C. shows performance advantageous for the heat-resistant storage property, but the low-temperature fixability is lost. Therefore, the peak temperature is preferably 70° C. or less. In this range, both the low-temperature fixability and the heat-resistant storage property can be further improved.

The toner particles prepared by the process of the present invention are produced by emulsion aggregation as described above. The emulsion aggregation is a toner producing method including a step of preparing aggregation particles by aggregating, for example, resin particles, colorant particles, and wax particles in a state dispersed in an aqueous medium (hereinafter also referred to as "aggregation step") and a step of fusing the aggregation particles to form fused particles (hereinafter also referred to as "fusion step").

Furthermore, the producing method of the present invention includes a step, posterior to the fusion step, of conducting heat treatment at a heating temperature t (° C.) satisfying the following expression (1):

$$Tp'-15.0 \leq t \leq Tp'-5.0 \quad (1)$$

(in the expression, Tp' represents the peak temperature of the maximum endothermic peak of the block polymer in the endothermic amount measurement with a DSC) for 0.5 hr or more and 50.0 hr or less. Hereinafter, this heat treatment may be referred to as annealing treatment, and the heat treatment step may be referred to as annealing step.

The annealing step is a step for increasing the crystallinity of a crystalline material. In general, the crystallinity of a crystalline material is lost once by heating to a temperature higher than the melting point, and a crystal is reformed (recrystallization) by cooling. However, if another material is contained, compatibility with such a material and a physical obstacle are caused to readily reduce the crystallinity. In the production of a toner by emulsion aggregation, since the heating to a temperature higher than the melting point is performed in the condition of containing other materials in the fusion step, the crystallinity is unavoidably reduced. Accordingly, it is necessary to increase the crystallinity by conducting the annealing step posterior to the fusion step. The annealing step may be performed at any stage as long as it is performed posterior to the fusion step. For example, particles in a slurry form may be subjected to the annealing treatment, or the annealing treatment may be performed prior to an external addition step or after the external addition.

The principle of an increase in crystallinity by performing the annealing step is thought as follows. In the annealing step, the molecular mobility of the high-molecular chain of the crystalline component becomes high to some extent, and thereby the molecular chain reorients to a stable structure, i.e., a regular crystal structure to cause recrystallization. In a temperature higher than the melting point, since the molecular chain has an energy larger than that for forming a crystal structure, the recrystallization mentioned above does not occur. Accordingly, in order to enhance the molecular movement as active as possible, it is necessary that the annealing temperature is lower than the melting point of the crystalline component by 5° C. or more and 15° C. or less. The melting point is defined as a peak temperature of the maximum endothermic peak of the block polymer. For example, the annealing temperature can be lower than the melting point of the crystalline component by 5° C. or more and 10° C. or less. By doing so, it is possible to effectively increase the degree of crystallinity to improve the environmental stability and the long period storage stability of the toner.

The annealing time can be appropriately adjusted depending on the rate of the block polymer to the toner and the type of the block polymer, but at least 0.5 hr is necessary. By adjusting the annealing time to at least 0.5 hr, an effect of increasing the degree of crystallinity can be sufficiently achieved. The annealing time can be adjusted to 1.0 hr or longer. However, since a higher effect cannot be expected even if the annealing treatment is performed for exceeding 50.0 hr, the annealing time is preferably 50.0 hr or less.

In the toner produced by the process of the present invention, the total endothermic amount (ΔH) of the endothermic peak attributed to the binder resin can be 30 J/g or more and 80 J/g or less per 1 g of the binder resin. The ΔH is not the total amount of the crystalline material in the toner, but represents the amount of the crystalline material present in a state maintaining the crystallinity in the toner. That is, if the crystallinity is deteriorated, the ΔH is small even if the toner contains a large amount of crystalline material therein. Accordingly, it is possible to adjust the amount of the crystalline material in a toner to an adequate range by controlling the ΔH in the above-mentioned range to provide more excellent low-temperature fixability and durability.

The crystalline polyester that becomes the portion capable of forming a crystal structure (hereinafter also referred to as crystalline polyester unit) in the block polymer will be described below.

In the crystalline polyester, at least an aliphatic diol having 4 to 20 carbon atoms and a multivalent carboxylic acid can be used as raw materials.

Furthermore, the aliphatic diol can be a straight chain type. By using a straight chain-type aliphatic diol, the crystallinity of a toner can be easily increased, and the definition of the present invention can be easily satisfied.

Examples of the aliphatic diol include, but not limited to, the following compounds: 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. These compounds may be used in combination. Among these compounds, 1,4-butanediol, 1,5-pentanediol, and 1,6-hexanediol are advantageous from the viewpoint of the melting point.

Furthermore, an aliphatic diol having a double bond can be used. Examples of the aliphatic diol having a double bond include the following compounds: 2-butene-1,4-diol, 3-hexene-1,6-diol, and 4-octene-1,8-diol.

Examples of the multivalent carboxylic acid include aromatic dicarboxylic acids and aliphatic dicarboxylic acids. Among them, the aliphatic dicarboxylic acids, in particular, straight chain-type dicarboxylic acids are advantageous from the viewpoint of crystallinity.

Examples of the aliphatic dicarboxylic acid include, but not limited to, the following compounds: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; and lower alkyl esters and acid anhydrides thereof. These compounds may be used in combination. Among these compounds, sebacic acid, adipic acid, 1,10-decanedicarboxylic acid, and their lower alkyl esters and acid anhydrides can be preferably used.

Examples of the aromatic dicarboxylic acid include the following compounds: terephthalic acid, isophthalic acid, 2,6-naphthalenedicarboxylic acid, and 4,4'-biphenyldicarboxylic acid. Among these compounds, terephthalic acid has advantage that it can be easily obtained and can easily form a polymer having a low melting point.

A dicarboxylic acid having a double bond can be also used. Examples of such a dicarboxylic acid include, but not limited to, fumaric acid, maleic acid, 3-hexenedioic acid, and 3-octenedioic acid; and lower alkyl esters and acid anhydrides thereof. Among these compounds, fumaric acid and maleic acid are advantageous from the viewpoint of cost.

The method of producing the crystalline polyester is not particularly limited, and the crystalline polyester can be produced by usual polyester polymerization through a reaction between an acid component and an alcohol component. For example, direct polycondensation or transesterification can be properly employed according to the types of monomers.

The crystalline polyester can be produced at a polymerization temperature of 180° C. or more and 230° C. or less. The reaction system may be under reduced pressure, and the reaction may be performed while removing water and alcohol generated during condensation. In the case of that a monomer is not dissolved or compatibilized at the reaction temperature, a solvent having a high boiling point can be added to the reaction system as a solubilizer for dissolving the monomer. In polycondensation, the reaction is performed while distilling away the solubilizing solvent. In the case of a monomer showing low compatibility in copolymerization, the monomer showing low compatibility may be condensed in advance with an acid or alcohol to be polycondensed with the monomer and may be then subjected to polycondensation together with the main component.

Examples of the catalyst that can be used in the production of the crystalline polyester include titanium catalysts such as titanium tetraethoxide, titanium tetrapropoxide, titanium tetraisopropoxide, and titanium tetrabutoxide; and tin catalysts such as dibutyltin dichloride, dibutyltin oxide, and diphenyltin oxide.

The crystalline polyester can have an alcohol terminal for preparing the block polymer. Accordingly, in preparation of the crystalline polyester, the mole ratio of the alcohol component to the acid component (alcohol component/carboxylic acid component) can be 1.02 or more and 1.20 or less.

The amorphous resin that becomes the portion not forming a crystal structure in the block polymer (hereinafter also referred to as amorphous polymer unit) will be described below. The Tg of the amorphous resin forming the amorphous polymer unit can be 50° C. or more and 130° C. or less, such as 70° C. or more and 130° C. or less. In this range, the elasticity in the fixing region can be readily maintained.

Examples of the amorphous resin include, but not limited to, polyurethane resins, polyester resins, styrene acrylic resins, polystyrene-based resins, and styrene butadiene-based resins. These resins may be subjected to urethane, urea, or epoxy modification. Among these resins, polyester resins and polyurethane resins are advantageous from the viewpoint of maintaining elasticity.

Examples of the monomer used for the polyester resins as the amorphous resins include divalent or trivalent carboxylic acids described in "Kobunshi Data Handbook: Kisohen (Data Handbook of Polymers: Basic Edition" (Soc. Polymer Science, Japan Ed.: Baihukan) and divalent or trivalent alcohols. Specific examples of these monomer components include the following compounds: divalent carboxylic acids such as dibasic acids of succinic acid, adipic acid, sebacic acid, phthalic acid, isophthalic acid, terephthalic acid, malonic acid, and dodecenylsuccinic acid, and their anhydrides and lower alkyl esters, and aliphatic unsaturated dicarboxylic acids of maleic acid, fumaric acid, itaconic acid, and citraconic acid; and tri- or more valent carboxylic acids such as 1,2,4-benzenetricarboxylic acid, and their anhydrides and lower alkyl esters. These may be used alone or in combination of two or more thereof.

Examples of the divalent alcohols include the following compounds: bisphenol A, hydrogenated bisphenol A, ethylene oxides of bisphenol A, propylene oxide adducts of bisphenol A, 1,4-cyclohexanediol, 1,4-cyclohexanedimethanol, ethylene glycol, and propylene glycol. Examples of the tri- or more valent alcohol include the following compounds: glycerin, trimethylolethane, trimethylolpropane, and pentaerythritol. These may be used alone or in combination of two or more thereof. Furthermore, in order to adjust the acid value or hydroxyl value, a monovalent acid such as acetic acid or benzoic acid or a monovalent alcohol such as cyclohexanol or benzyl alcohol can be optionally used.

The polyester resin as the amorphous resin can be synthesized by a known method using the above-mentioned monomer components.

A polyurethane resin as the amorphous resin will be described. The polyurethane resin is a reaction product of a diol and a material having a diisocyanate group and can become a resin having various functions by adjusting the diol and the diisocyanate.

Examples of the diisocyanate component include the following compounds.

The examples include aromatic diisocyanates having 6 to 20 carbon atoms (excluding carbons in NCO groups, hereinafter the same shall apply), aliphatic diisocyanates having 2 to 18 carbon atoms, alicyclic diisocyanates having 4 to 15 carbon atoms, aromatic hydrocarbon diisocyanates having 8 to 15 carbon atoms; modified products of these diisocyanates (modified products containing a urethane group, a carbodiimide group, an allophanate group, a urea group, a biuret group, a uretdione group, a uretimine group, an isocyanurate group, or an oxazolidone, hereinafter also referred to modified diisocyanate); and mixtures of two or more thereof.

Examples of the aliphatic diisocyanate include ethylene diisocyanate, tetramethylene diisocyanate, hexamethylene diisocyanate (HDI), and dodecamethylene diisocyanate.

Examples of the alicyclic diisocyanate include isophorone diisocyanate (IPDI), dicyclohexylmethane-4,4'-diisocyanate, cyclohexylene diisocyanate, and methylcyclohexylene diisocyanate.

Examples of the aromatic hydrocarbon diisocyanate include m- and/or p-xylylene diisocyanate (XDI) and α,α,α',α'-tetramethylxylylene diisocyanate.

Among these compounds, in particular, aromatic diisocyanates having 6 to 15 carbon atoms, aliphatic diisocyanates having 4 to 12 carbon atoms, alicyclic diisocyanates having 4 to 15 carbon atoms, and aromatic hydrocarbon diisocyanates can be preferably used, and HDI, IPDI, and XDI are particularly preferred.

As the polyurethane resin, in addition to the above-mentioned diisocyanate components, tri- or more functional isocyanates can be used.

Examples of the diol component that can be used for the urethane resin include the following compounds.

The examples include alkylene glycols (ethylene glycol, 1,2-propylene glycol, and 1,3-propylene glycol); alkylene ether glycols (polyethylene glycol and polypropylene glycol); alicyclic diols (1,4-cyclohexanedimethanol); bisphenols (bisphenol A); and alkylene oxide (ethylene oxides and propylene oxide) adducts of the alicyclic diols. The alkyl moieties of the alkylene ether glycols may be either straight or branched. In the present invention, alkylene glycols having branched structures also can be used.

In the present invention, as the method of preparing the block polymer, a method (two-stage method) in which a crystalline resin serving as a unit of forming a crystalline portion and an amorphous resin serving as a unit of forming an amorphous portion are separately prepared and both resins are linked or a method (one-stage method) in which a raw material for the crystalline resin serving as a unit of forming a crystalline portion and a raw material for the amorphous resin serving as a unit of forming an amorphous portion are simultaneously charged to prepare the block polymer at one time.

The block polymer in the present invention can be prepared by a method selected from various methods in the light of reactivity of each terminal functional group.

When both the crystalline resin and the amorphous resin are polyester resins, the block polymer can be prepared by separately preparing each unit and binding the units using a binder. In particular, when one polyester has a high acid value and the other polyester has a high hydroxyl value, the reaction smoothly proceeds. The reaction temperature can be approximately 200° C.

Examples of the binder include multivalent carboxylic acids, polyhydric alcohols, multivalent isocyanates, multifunctional epoxy compounds, and multivalent anhydrides. The block polymer can be synthesized by dehydration or addition reaction using these binders.

When the amorphous resin is a polyurethane resin, the block polymer can be prepared by separately preparing each unit and then subjecting the alcohol terminal of the crystalline polyester and the isocyanate terminal of the polyurethane to urethanation reaction. Alternatively, the block polymer can be synthesized by mixing a crystalline polyester having an alcohol terminal, a diol constituting the polyurethane resin, and diisocyanate and heating the resulting mixture. In the initial stage of the reaction, the diol and the diisocyanate are in high concentrations and are selectively react with each other to form a polyurethane resin, and then urethanation reaction occurs between the isocyanate terminal of the polyurethane resin having a molecular weight increased to some extent and the alcohol terminal of the crystalline polyester to form a block polymer.

In the block polymer of the present invention, examples of the binding form of the covalent bond between the portion capable of forming a crystal structure and the portion not forming a crystal structure include ester bonds, urea bonds, and urethane bonds. In particular, the block polymer can include a portion capable of forming a crystal structure linked by a urethane bond. The block polymer having urethane bonds can easily maintain elasticity even in the fixing region.

In order to adjust the acid value of the block polymer, the isocyanate group, hydroxyl group, or carboxyl group at the terminal of the block polymer may be modified using, for example, a multivalent carboxylic acid, a polyhydric alcohol, a multivalent isocyanate, a multifunctional epoxy compound, a multiacid anhydride, or a multivalent amine.

Furthermore, in the toner obtained by the producing method of the present invention, the half-value width of the endothermic peak attributed to the binder resin can be 5.0° C. or less. If the half-value width is larger than 5.0° C., the crystal condition tends to change during storage for a long time.

The emulsion aggregation employed in the present invention as the method of producing toner particles will be described in detail below.

In the emulsion aggregation, resin particles, toner particles are prepared through an aggregation step to obtain aggregation particles by aggregating resin particles, wax particles, colorant particles, and other particles dispersed in an aqueous medium and a fusion step to fuse the aggregation particles. The toner particle diameter and the particle size distribution can be adjusted by adjusting the degree of the aggregation. More specifically, the aggregation particles are formed by mixing a dispersion of the resin particles, a dispersion of the wax particles, and a dispersion of the colorant particles and adding a flocculant to the resulting mixture to cause hetero-aggregation. On this occasion, a dispersion of optional materials to be contained in a toner may be mixed with the mixtures of the dispersions and subjected to the aggregation. Then, the aggregation particles are fused by being heated to a temperature higher than the melting point of the resin particles, and the particles are washed and dried to provide toner particles. In this method, the toner shape can be controlled from formless to spherical by selecting the heating temperature conditions.

The resin particle dispersion may be prepared by any known method. For example, fine particles may be produced by polymerization, and an emulsion or dispersion may be formed using mechanical shearing or ultrasonic waves.

The resin particle dispersion may contain a surfactant or an additive such as a high-molecular dispersant or an inorganic dispersant, and it is possible to optionally add the surfactant or the additive such as a high-molecular dispersant or an inorganic dispersant to the aqueous medium during the emulsification dispersing.

In the present invention, examples of the aqueous medium include distilled water and deionized water. The aqueous medium may contain a water miscible organic solvent. Examples of the water miscible organic solvent include alcohols such as ethanol and methanol; and acetone.

Examples of the surfactant that can be used in the present invention include anionic surfactants such as sulfate, sulfonate, and phosphate surfactants; cationic surfactants such as amine salt and quaternary ammonium salt surfactants; and nonionic surfactants such as polyethylene glycol, alkylphenol ethylene oxide adduct, and polyhydric alcohol surfactants. Among these surfactants, anionic surfactants and cationic surfactants are particularly preferred.

These surfactants may be used alone or in combination of two or more thereof. The nonionic surfactants can be used in combination with the anionic surfactants or the cationic surfactants.

Examples of the high-molecular dispersant include sodium polycarboxylate and polyvinyl alcohol, and examples of the inorganic dispersant include calcium carbonate, but the present invention is not particularly limited by these compounds.

Furthermore, the resin particle dispersion may contain a higher alcohol represented by heptanol or octanol or a higher aliphatic hydrocarbon represented by hexadecane as a stabilizing assistant.

In the aggregation step of the present invention, two or more types of resin particle dispersions are mixed, and the steps posterior to the aggregation may be conducted. On this occasion, it is also possible to form multilayer particles by previously aggregating a first resin particle dispersion to form first aggregation particles and then further adding a second resin particle dispersion to the first aggregation particles to form second shell layer on the first particle surface.

As the flocculant, not only a surfactant having a polarity opposite to that of the surfactant used as the dispersant but also inorganic salt or a di- or more valent metal salt can be used. In particular, a metal salt can be used from the viewpoints of controlling the aggregation and the toner charging property. The metal salt compound that is used in aggregation is obtained by dissolving a common inorganic metal compound or its polymer in a resin particle dispersion. The metal element constituting the inorganic metal salt may be any metal that has a di- or more valent charge and can be dissolved in a form of ion in the aggregation system of resin particles. Specific examples of the inorganic metal salt include metal salts such as calcium chloride, calcium nitrate, barium chloride, magnesium chloride, zinc chloride, aluminum chloride, and aluminum sulfate; and inorganic metal salt polymers such as aluminum polychloride, aluminum polyhydroxide, and calcium polysulfide. Among them, aluminum salts and their polymers are particularly preferred. In general, in order to obtain a sharper particle size distribution, an inorganic metal salt having a larger valent is preferred, i.e., divalent is better than monovalent, and tri- or more valent is better than divalent. Furthermore, even if the valent is the same, an inorganic metal salt polymer is more suitable.

The toner produced by the process of the present invention needs a colorant for exhibiting its coloring ability. Examples of the colorant include organic pigments, organic dyes, and inorganic pigments, and colorants used in known toners can be used. The colorant is selected from the points of hue angle, saturation, brightness, light resistance, OHP transparency, and dispersability in a toner.

The colorant can be used in an amount of 1 part by mass or more and 20 parts by mass or less based on 100 parts by mass of the binder resin.

Next, examples of the method of producing the colorant dispersion will be described. Colorants may be used alone or in combination. The dispersion of these colorants can be prepared by any usual method, for example, by using a rotary shearing homogenizer, a medium-disperser such as a ball mill, a sand mill, or an attriter, a high-pressure countercollision disperser, or a dyno mill.

These colorants may also be dispersed in an aqueous system using a polar surfactant with a homogenizer. The colorant may be added together with another fine particle component to a solvent mixture or may be dividedly added in a multi-stage manner.

The particle diameter (median diameter: D50) of the colorant particles in a toner can be 100 nm or more and 330 nm or less from the viewpoint of glossiness.

The median diameter of colorant particles is measured with, for example, a laser-diffraction particle size distribution analyzer (LA-920, manufactured by Horiba, Ltd.).

Examples of the wax used in the present invention include aliphatic hydrocarbon waxes such as low-molecular-weight polyethylene, low-molecular-weight polypropylene, low-molecular-weight olefin copolymers, microcrystalline waxes, paraffin waxes, and Fischer-Tropsch waxes; oxides of aliphatic hydrocarbon waxes such as oxidized polyethylene waxes; waxes containing fatty acid ester as a main component such as aliphatic hydrocarbon ester waxes; partially or completely deacidified fatty acid ester such as deacidified carnauba waxes; partially esterified products of fatty acid and polyhydric alcohol, such as behenic acid monoglyceride; and methylyl ester compounds having hydroxyl groups prepared by hydrogenation of vegetable oils.

The wax that can be used in the present invention is aliphatic hydrocarbon waxes and ester waxes from the viewpoints of exudation property and releasing property.

The ester wax in the present invention may be any ester that has at least one eater bond in one molecule and may be either a natural ester wax or a synthetic ester wax.

Examples of the synthetic ester wax include monoester waxes synthesized from long straight-chain saturated fatty acid and long straight-chain saturated alcohol. The long straight-chain saturated fatty acid is represented by a general formula: $C_nH_{2n+1}COOH$, wherein n can be an integer of 5 to 28. The long straight-chain saturated alcohol is represented by a general formula: $C_nH_{2n+1}OH$, wherein n can be an integer of 5 to 28.

Examples of the natural ester wax include candelilla wax, carnauba wax, and rice wax and derivatives thereof.

Among the above-mentioned waxes, a synthetic ester wax synthesized from long straight-chain saturated fatty acid and long straight-chain saturated aliphatic alcohol or a natural wax of which main component is the ester mentioned above can be preferably used.

Furthermore, in the present invention, in addition to that the wax has the straight-chain structure, the ester of the wax is a monoester.

In the process of the present invention, the content of the wax in a toner can be 5.0 parts by mass or more and 20.0 parts by mass or less, such as 5.0 parts by mass or more and 15.0 parts by mass or less, based on 100 parts by mass of the binder resin. In this range, winding of transfer paper at low temperature can be satisfactorily prevented while maintaining a good heat-resistant storage property.

In the wax of the present invention, the peak temperature of a maximum endothermic peak can be 60° C. or more and 120° C. or less, such as 60° C. or more and 90° C. or less, in endothermic amount measurement with a differential scanning calorimeter (DSC).

Next, a method of producing the wax dispersion will be described. A dispersion of wax particles having a diameter of 1 μm or less can be produced by dispersing the wax in water together with an ionic surfactant and a polymer electrolyte of a polymer acid or a polymer base; and heating the dispersion to a temperature higher than the melting point of the wax and simultaneously dispersing the wax into a particle form using a homogenizer or a pressure discharge disperser (GAULIN HOMOGENIZER, manufactured by Gaulin Corp.) that can provide high shearing strength.

The particle diameter (median diameter: D50) in the resulting wax dispersion can be measured with a laser-diffraction particle size distribution analyzer (LA-920, manufactured by Horiba, Ltd.). In the case of using a wax, it is advantageous to aggregate resin particles, colorant particles, and wax particles and then add a resin particle dispersion thereto such that the resin particles adhere to the aggregated particle surfaces, from the viewpoint of securing a chargeability and durability.

In the toner prepared by the producing method of the present invention, a charge control agent can be optionally mixed with the toner particles. The charge control agent may be added during producing the toner particles. By containing the charge control agent, it is possible to stabilize charge characteristics and to optimize the amount of frictional charge according to a development system.

Any known charge control agent can be used, in particular, a charge control agent that shows rapid charging and can stably maintain a constant amount of charge can be used. Furthermore, a material that is hardly dissolved in water is advantageous from the viewpoint of controlling ionic strength that affects aggregation or stability during fusing.

As the charge control agent for negatively charging a toner, organic metal compounds and chelate compounds are effective, and examples thereof include the following metal compounds: monoazo metal compounds, acetylacetone metal compounds, aromatic oxycarboxylic acids, aromatic dicarboxylic acids, oxycarboxylic acids, and dicarboxylic acids.

The toner prepared by the producing method of the present invention can contain these charge control agents alone or in combination of two or more thereof.

The content of the charge control agent can be 0.01 parts by mass or more and 20 parts by mass or less, such as 0.5 parts by mass or more and 10 parts by mass or less, based on 100 parts by mass of the binder resin.

After completion of the fusion step of the aggregation particles, toner particles are obtained optionally through a washing step, a solid-liquid separation step, and a drying step. In the washing step, the toner particles may be sufficiently washed with deionized water, in the light of chargeability. The solid-liquid separation step is not particularly limited, but may be performed by vacuum filtration or pressure filtration from the viewpoint of productivity. Furthermore, the drying step is not particularly limited, but may be performed by lyophilization, flash jet drying, fluidized drying, or vibrating fluidized drying from the viewpoint of productivity.

The toner prepared by the producing method of the present invention can contain inorganic fine particles as a fluidity improver.

Examples of the inorganic fine particles added to the toner particles include silica fine particles, titanium oxide fine particles, alumina fine particles, and fine particles of their double oxides. Among these inorganic fine particles, silica fine particles and titanium oxide fine particles are preferred.

Examples of the silica fine particles include dry silica or fumed silica generated by vapor phase oxidation of a silicon halide and wet silica prepared from water glass. The inorganic fine particles can be dry silica in which the number of silanol groups present on the surface and inside the silica particles is small and also the numbers of $Na_2O$ and $SO_3^{2-}$ are small. The dry silica may be complex fine particles of silica and another metal oxide produced by using a metal halide compound such as aluminum chloride or titanium chloride together with a silicon halide compound during the production process.

The inorganic fine particles can be externally added to the toner particles for improving the fluidity of a toner and uniformizing the charge of toner particles. Adjustment of the amount of charge of a toner, improvement in environmental stability, and improvement in characteristics under a high humidity environment can be achieved by hydrophobizing treatment of the inorganic fine particles. Accordingly, it is advantageous to use hydrophobized inorganic fine particles. Moisture absorption by the inorganic fine particles added to a toner decreases the amount of charge as the toner, which tends to cause reductions in developing property and transferring property.

Examples of the treatment agent for the hydrophobization of the inorganic fine particles include unmodified silicone varnishes, various types of modified silicone varnishes, unmodified silicone oils, various types of modified silicone oils, silane compounds, silane coupling agents, other organic silicon compounds, and organic titanium compounds. These treatment agents may be used alone or in combination.

Among them, in particular, inorganic fine particles treated with silicone oils can be used. Furthermore, hydrophobized inorganic fine particles that have been treated with a silicone oil simultaneously or after hydrophobizing treatment with a coupling agent can maintain a high amount of charge of toner particles even under a high-moisture environment and can reduce selective development.

The content of the inorganic fine particles can be 0.1 parts by mass or more and 4.0 parts by mass or less, such as 0.2 parts by mass or more and 3.5 parts by mass or less, based on 100 parts by mass of the toner particles. Within the content mentioned above, sufficient effects on improvement in fluidity of a toner and uniformization of charge of toner particles can be obtained.

The toner prepared by the producing method of the present invention can have an average sphericity of 0.940 or more and 0.980 or less, such as 0.950 or more and 0.970 or less. Within this range, not only satisfactory transferring property and fluidity but also satisfactory cleaning property can be obtained.

The toner prepared by the producing method of the present invention can have a weight-average particle diameter (D4) of 3.0 μm or more and 8.0 μm or less, such as 5.0 μm or more and 7.0 μm or less.

Furthermore, in the toner prepared by the producing method of the present invention, the ratio of the weight-average particle diameter (D4) to the number-average particle diameter (D1), D4/D1, can be 1.25 or less, such as 1.20 or less.

The toner prepared by the producing method of the present invention can have a number-average molecular weight (Mn) of 8000 or more and 30000 or less, such as 10000 or more and 20000 or less, and a weight-average molecular weight (Mw) of 15000 or more and 60000 or less, such as 20000 or more and 50000 or less, in gel permeation chromatography (GPC) measurement of tetrahydrofuran (THF) soluble components. Within this range, appropriate viscoelasticity can be provided to the toner. The Mw/Mn can be 6 or less, such as 3 or less.

Methods measuring various physical properties of the toner and the toner materials in the producing method of the present invention will be described below.

Methods of Measuring Tp, Tp', ΔH, and Half-Value Width of Endothermic Peak Attributed to Binder Resin The peak temperature Tp of the maximum endothermic peak attributed to a binder resin, the peak temperature Tp' of the maximum endothermic peak of a block polymer, the total quantity of heat ΔH of the endothermic peak attributed to a binder resin, and the half-value width of the endothermic peak attributed to a binder resin are measured using a differential scanning calorimeter DSC Q1000 (manufactured by TA Instruments Japan Inc.) under the following conditions:

Temperature-rising rate: 10° C./min

Measurement starting temperature: 20° C.

Measurement terminating temperature: 180° C.

The temperature of the apparatus detector is corrected using the melting points of indium and zinc, and the quantity of heat is corrected using the heat of fusion of indium.

Specifically, about 5 mg of a sample is accurately weighed and is placed in a silver pan, and the endothermic amount thereof is measured once to obtain a DSC curve. Based on this DSC curve, Tp, Tp', ΔH, and half-value width of endothermic peak attributed to the binder resin are determined. As a reference, the empty silver pan is used.

In the case of measuring a toner as a sample, when the maximum endothermic peak attributed to a binder resin does not overlap with an endothermic peak of a wax, the obtained maximum endothermic peak is directly used as the endothermic peak attributed to the binder resin. On the contrary, in the measurement of a toner, when the maximum endothermic peak attributed to a binder resin overlaps with an endothermic peak of a wax, it is necessary to subtract the endothermic amount attributed to the wax from the endothermic amount of the maximum endothermic peak.

For example, it is possible to determine the endothermic peak attributed to a binder resin by subtracting the endothermic amount attributed to the wax from the endothermic amount of the obtained maximum endothermic peak by the following manner.

First, the endothermic amount of a wax alone is separately measured with a DSC to determine the endothermic characteristics of the wax. Then, the content of the wax in a toner is measured. The method of measuring the wax content in a toner is not particularly limited, and, for example, peak separation in the endothermic amount measurement with a DSC or known structural analysis can be employed. Subsequently, the endothermic amount attributed to the wax is calculated from the wax content in the toner, and this endothermic amount is subtracted from the maximum endothermic peak. If the wax is highly compatible to resin components, it is necessary to calculate the endothermic amount attributed to the wax by multiplying the wax content by the compatibility ratio and then conduct the subtraction. The compatibility ratio is calculated from the value obtained by dividing the endothermic amount of a mixture of resin components and the wax at a predetermined ratio by theoretical endothermic amount calculated from the endothermic amount of the fusion mixture and the endothermic amount of the wax alone.

In the measurement of ΔH, in order to determine the endothermic amount per 1 g of a binder resin in the measurement of endothermic amount with a DSC, it is necessary to subtract the mass of components other than the binder resin from the mass of the sample.

The content of the components other than the resin components can be calculated based on the formula ratio, but when the formula ratio is unclear, the content can be measured by a known analysis measure. If the analysis is difficult, the content can be determined by measuring the amount of residual burnt ash of a toner, adding the amount of components such as the wax, excluding the binder resin to be burnt, to the ash amount and subtracting the determined sum as the content of components excluding the binder resin from the mass of the toner.

The residual burnt ash of a toner can be determined by the following procedure. About 2 g of a sample is put in a 30-mL magnetic crucible of which weight has been previously weighed. The crucible is placed in an electric furnace, is heated at about 900° C. for about 3 hr, then is left to cool in the electric furnace, and is left to cool at an ordinary temperature in a desiccator for 1 hr or more. The total mass of the crucible containing the residual burnt ash is weighed, and the amount of the residual burnt ash is calculated by subtracting the mass of the crucible from the total mass.

The maximum endothermic peak is the peak showing the highest endothermic amount when there is a plurality of peaks. The half-value width is a temperature range at the half height of an endothermic peak.

Method of Measuring Melting Point of Wax

The melting point of a wax is measured using a differential scanning calorimeter DSC Q1000 (manufactured by TA Instruments Japan Inc.) under the following conditions:

Temperature-rising rate: 10° C./min

Measurement starting temperature: 20° C.

Measurement terminating temperature: 200° C.

The temperature of the apparatus detector is corrected using the melting points of indium and zinc, and the quantity of heat is corrected using the heat of fusion of indium.

Specifically, about 2 mg of a wax is accurately weighed and is placed in a silver pan and is subjected to differential scanning calorie measurement using the empty silver pan as a reference. In the measurement, the temperature is increased to 200° C. once and is then decreased to 30° C. Subsequently, the temperature is increased again. The peak temperature of the maximum endothermic peak of the DSC curve in the temperature range of 30 to 200° C. in the second temperature-increasing process is defined as the melting point of the wax. The maximum endothermic peak is the peak showing the highest endothermic amount.

Methods of Measuring Mn and Mw

The number-average molecular weight Mn and the weight-average molecular weight Mw of the THF-soluble components of the toner and its raw materials used in the present invention are measured as follows.

First, a sample is dissolved in THF at room temperature over 24 hr. The resulting solution is filtered through a solvent-resistant membrane filter having a pore diameter of 0.2 μm, "Maeshori Disk" (manufactured by Tosoh Corp.) to obtain a sample solution. The sample solution is adjusted so that the concentration of components soluble in THF is about 0.8 mass %. Measurement is performed using this sample solution under the following conditions:

Apparatus: HLC8120 GPC (detector: RI) (manufactured by Tosoh Corp.)

Column: a connection of seven columns of SHODEX KF-801, 802, 803, 804, 805, 806, and 807 (manufactured by Showa Denko K.K.)

Eluent: tetrahydrofuran (THF)

Flow rate: 1.0 mL/min

Oven temperature: 40.0° C.

Sample injection amount: 0.10 mL

In the calculation of molecular weight of the sample, a molecular weight calibration curve prepared by using standard polystyrene resins (for example, trade names "TSK Standard Polystyrene F-850, F-450, F-288, F-128, F-80, F-40, F-20, F-10, F-4, F-2, F-1, A-5000, A-2500, A-1000, and A-500", manufactured by Tosoh Corp.) is used. The weight-average molecular weight Mw and the number-average molecular weight Mn of the THF-soluble components of the toner and its raw materials used are calculated from the molecular weight distribution obtained by applying the molecular weight calibration curve to the chart obtained by GPC measurement.

Measurement of Particle Diameter of Colorant Particles and Wax Particles

The median diameters (D50) as volume criteria of the colorant particles in a colorant dispersion and the wax particles in a wax dispersion are measured in accordance with JIS Z8825-1 (2001). Specific measurement is as follows.

As the measurement apparatus, a laser diffraction/scattering particle size distribution analyzer "LA-920" (manufactured by Horiba, Ltd.) is used. The setting of measurement conditions and the analysis of measurement data are performed with dedicated software "HORIBA LA-920 for Windows (registered trademark) WET (LA-920) Ver. 2.02" (manufactured by Beckman Coulter, Inc.) attached to LA-920. As a measurement solvent, deionized water previously subjected to removal of impurity solids is used.

The measurement procedure is as follows:

(1) Attach a batch-type cell holder to LA-920;

(2) Put a predetermined amount of deionized water to the batch-type cell, and set the batch-type cell to the batch-type cell holder;

(3) Stir the inside of the batch-type cell with a dedicated stirrer chip;

(4) Press the "refractive index" button on the "display condition setting" screen, and select the file "110A000I" (relative refractive index: 1.10);

(5) Set the particle diameter criteria to the volume criteria on the "display condition setting" screen;

(6) After warming-up operation for 1 hr or more, perform adjustment of the optical axis, fine adjustment of the optical axis, and measurement of a blank; and (7) Immediately, gradually add a dispersion of a sample to the batch-type cell while avoiding air bubbles from being included to adjust the transmittance of light from a tungsten lamp to 90 to 95%. Then, measure the particle size distribution, and calculate the median diameter (D50) of volume criteria based on the resulting article size distribution data of volume criteria.

Method of Measurement of Average Sphericity of Toner

The average sphericities of a toner during a correction operation and under analysis conditions are measured with a flow particle image analyzer "FPIA-3000" (manufactured by Sysmex Corp.).

A specific method of measurement is as follows. First, about 20 mL of deionized water previously subjected to removal of impurity solids is put in a glass container. About 0.2 mL of a diluted solution prepared by diluting a "CONTAMINON N" (a 10 mass % aqueous solution of a precision-measuring-device-washing neutral detergent composed of a nonionic surfactant, an anionic surfactant, and an organic builder and having a pH of 7, manufactured by Wako Pure Chemical Industries, Ltd.) with deionized water by about three mass fold is added to the container as a dispersant. Furthermore, about 0.02 g of a sample to be measured is added thereto, followed by dispersion treatment for 2 min using an ultrasonic dispersing device to provide a dispersion for measurement. During the measurement, the dispersion is properly cooled so that the temperature of the dispersion is 10° C. or more and 40° C. or less. As the ultrasonic dispersing device, a desktop ultrasonic cleaning and dispersing device having an oscillatory frequency of 50 kHz and an electrical output of 150 W (for example, "VS-150" (manufactured by Velvo-Clear Co., Ltd.)) is used. A predetermined amount of deionized water is put into a water tank and about 2 mL of CONTAMINON N described above is added to this water tank.

In the measurement, the above-described flow particle image analyzer equipped with an objective lens "UPLANAPRO" (10 times, numerical aperture: 0.40) is used, and Particle Sheath "PSE-900A" (manufactured by Sysmex Corp.) is used as a sheath liquid. The dispersion prepared according to the above-described procedure is introduced into the above-described flow particle image analyzer, and 3000 toner particles are measured under a total count mode in HPF measurement mode. Then, a binarization threshold value in particle analysis is specified to be 85%, the analyzed particle diameter is limited to a circle-equivalent diameter of 1.985 μm or more and less than 39.69 μm, and the average sphericity of the toner is determined.

In the measurement, prior to the start of the measurement, automatic focus adjustment is performed using standard latex particles (for example, "RESEARCH AND TEST PARTICLES Latex Microsphere Suspensions 5200A" manufactured by Duke Scientific Corp. is diluted with deionized water). Thereafter, the focus adjustment can be performed every two hours after the start of the measurement.

It should be noted that, in each example, a flow particle image analyzer which had been subjected to a calibration operation by Sysmex Corp., and which had received a calibration certificate issued by Sysmex Corp. was used. The measurement is performed under measurement and analysis conditions identical to those at the time of the reception of the calibration certificate except that the analyzed particle diameter is limited to a circle-equivalent diameter of 1.985 μm or more and less than 39.69 μm.

Methods of Measuring Weight-Average Particle Diameter (D4) and Number-Average Particle Diameter (D1)

The weight-average particle diameter (D4) and the number-average particle diameter (D1) of a toner are calculated as follows. As the measurement apparatus, a precision particle size distribution measurement apparatus "COULTER COUNTER MULTISIZER 3" (registered trademark, manufactured by Beckman Coulter, Inc.) equipped with a 100 μm aperture tube and being based on a pore electrical resistance method is used. The setting of measurement conditions and the analysis of measurement data are performed with dedicated software "BECKMAN COULTER MULTISIZER 3 VERSION 3.51" (manufactured by Beckman Coulter, Inc.) included in the apparatus. The measurement is performed with the number of effective measurement channels set to 25000.

As the electrolyte solution used in the measurement, those prepared by dissolving special grade sodium chloride in deionized water at a concentration of about 1 mass %, for example, "ISOTON II" (manufactured by Beckman Coulter, Inc.), can be used.

The dedicated software is set as described below prior to the measurement and the analysis.

In the screen of "changing standard measurement method (SOM)" of the dedicated software, the total count number of a control mode is set to 50000 particles, the number of measurement is set to once, and a value obtained using "STANDARD PARTICLES: 10.0 μm (manufactured by Beckman Coulter, Inc.) is set as the Kd value. The threshold and the noise level are automatically set by pressing the "threshold/noise level measurement button". In addition, the current is set to 1600 μA, the gain is set to 2, and the electrolyte solution is set to an ISOTON II, and a check mark is placed in the "aperture tube is flushed after the measurement".

In the screen for "setting of conversion from pulse to particle diameter" of the dedicated software, the bin interval is set to a logarithmic particle diameter, the number of particle diameter bins is set to 256, and the particle diameter range is set to a range of 2 to 60 μm.

The specific measurement of the weight-average particle diameter (D4) and the number-average particle diameter (D1) is as follows:

(1) About 200 mL of the electrolyte solution is put in a 250-mL round-bottom glass beaker dedicated for the Multisizer 3. The beaker is set in a sample stand, and the electrolyte solution is stirred with a stirrer rod at 24 r/sec in a counter-clockwise direction. Then, the dirt and bubbles in the aperture tube are removed by the "aperture flush" function of the dedicated software.

(2) About 30 mL of the electrolyte solution is put in a 100-mL flat-bottom glass beaker. About 0.3 mL of a diluted solution prepared by diluting a "CONTAMINON N" (a 10 mass % aqueous solution of a precision-measuring-device-washing neutral detergent composed of a nonionic surfactant, an anionic surfactant, and an organic builder and having a pH of 7, manufactured by Wako Pure Chemical Industries, Ltd.) with deionized water by about three mass fold is added to the beaker as a dispersing agent.

(3) An ultrasonic dispersing device having an electrical output of 120 W, "ULTRASONIC DISPERSION SYSTEM TETORA 150" (manufactured by Nikkaki Bios Co., Ltd.), in which two oscillators each having an oscillatory frequency of 50 kHz are built-in with a phase displacement of 180° from each other, is prepared. About 3.3 L of deionized water is put in the water tank of the ultrasonic dispersing device, and about 2 mL of the CONTAMINON N is then added to the water tank.

(4) The beaker in the above (2) is set in the beaker fixing hole of the ultrasonic dispersing device, and the ultrasonic dispersing device is operated. Then, the height position of the beaker is adjusted so that the resonant state of the liquid surface of the electrolyte solution in the beaker becomes the maximum.

(5) About 10 mg of a toner is gradually added to the electrolyte solution in the beaker in the above (4) while irradiating the electrolyte solution with ultrasonic waves to disperse the toner. The ultrasonic dispersion treatment is further continued for 60 seconds. In the ultrasonic dispersion, the temperature of water in the tank is properly adjusted to 10° C. or more and 40° C. or less.

(6) The electrolyte solution in the above (5) in which the toner has been dispersed is dropped with a pipette in the round-bottom beaker in the above (1) set in the sample stand until the concentration of the toner becomes about 5%. Then, measurement is performed until 50000 particles are counted.

(7) The measurement data is analyzed with the dedicated software included with the apparatus, and the weight-average particle diameter (D4) and the number-average particle diameter (D1) are calculated. Note that the "average diameter" on the "analysis/volume statistics (arithmetic average)" screen, when the dedicated software is set to show a graph/volume %, is the weight-average particle diameter (D4) and that the "average diameter" on the "analysis/number statistics (arithmetic average)" screen, when the dedicated software is set to show a graph/number %, is the number-average particle diameter (D1).

Method of Measuring Rate of Portion Capable of Forming Crystal Structure

The rate of the portion capable of forming a crystal structure in the binder resin is calculated from the rate of the portion capable of forming a crystal structure in the raw material resins.

The measurement of the rate of the portion capable of forming a crystal structure in raw material resins is performed by $^{1}$H-NMR under the following conditions:

Measurement apparatus: FT NMR apparatus, JNM-EX400 (manufactured by JEOL Ltd.)

Measurement frequency: 400 MHz

Pulse condition: 5.0 μs

Frequency range: 10500 Hz

Cumulated number: 64 times

Measurement temperature: 30° C.

Sample: prepared by putting 50 mg of a sample to be measured in a sample tube with an inner diameter of 5 mm, adding deuterated chloroform ($CDCl_3$) to the sample as a solvent, and heating the mixture in a thermostatic chamber of 40° C. for dissolution.

In the obtained $^1$H-NMR chart, from peaks attributed to the constitutional elements of the portion capable of forming a crystal structure, a peak that is independent of peaks attributed to other elements is selected, and the integrated value $S_1$ of this peak is calculated. Similarly, from peaks attributed to constitutional elements of the portion not forming a crystal structure, a peak that is independent of peaks attributed to other constitutional elements is selected, and the integrated value $S_2$ of this peak is calculated.

The rate of the portion capable of forming a crystal structure is determined using the integrated values $S_1$ and $S_2$ by the following expression:

$$\text{Rate of portion capable of forming crystal structure (mol \%)}=\{(S_1/n_1)/((S_1/n_1)+(S_2/n_2))\}\times 100$$

wherein, $n_1$ and $n_2$ each represent the number of hydrogen of the constitutional element to which the peak attributed in each portion.

The rate (mol %) of the portion capable of forming a crystal structure is converted into mass % by the molecular weight of each component.

The structure of the portion capable of forming a crystal structure is separately analyzed by a known method. In the block polymer described in examples, as the portion capable of forming a crystal structure, the integrated value of a peak attributed to the diol component contained in the crystalline polyester component is used. As the portion not forming a crystal structure, the integrated value of a peak attributed to the isocyanate component is used.

EXAMPLES

The present invention will be described more specifically with reference to production examples and examples below, but these examples do not limit the present invention.

Synthesis of Crystalline Polyester 1

The following materials:

sebacic acid: 136.8 parts by mass, 1,4-butanediol: 63.2 parts by mass, and dibutyltin oxide: 0.1 parts by mass are charged in a heat dried two-necked flask with introducing nitrogen. The inside of the system is replaced by nitrogen through reduced pressure, followed by stirring at 180° C. for 6 hr. Subsequently, the temperature of the reaction mixture is gradually increased to 230° C. under reduced pressure while continuing the stirring, and the stirring is further continued at the same temperature for 2 hr. When the reaction mixture has become viscous, the reaction is terminated by air cooling to obtain crystalline polyester 1. The physical properties of the synthesized crystalline polyester 1 are shown in Table 2.

Synthesis of Crystalline Polyesters 2 to 8

Crystalline polyesters 2 to 8 are similarly synthesized as in the synthesis of crystalline polyester 1 except that raw materials are changed as shown in Table 1. The physical properties of crystalline polyesters 2 to 8 are shown in Table 2.

TABLE 1

| | Acid component | | Alcohol component | |
|---|---|---|---|---|
| | Material/amount (part by mass) | Material/amount (part by mass) | Material/amount (part by mass) | Alcohol/ acid mole ratio |
| Crystalline polyester 1 | sebacic acid/ 136.8 | — | 1,4-butanediol/ 63.2 | 1.05 |
| Crystalline polyester 2 | sebacic acid/ 112.5 | adipic acid/ 22.0 | 1,4-butanediol/ 65.5 | 1.05 |
| Crystalline polyester 3 | tetradecanedioic acid/135.0 | — | 1,6-hexanediol/ 65.0 | 1.06 |
| Crystalline polyester 4 | sebacic acid/ 107.0 | adipic acid/ 27.0 | 1,4-butanediol/ 66.0 | 1.04 |
| Crystalline polyester 5 | octadecanedioic acid/152.6 | — | 1,4-butanediol/ 47.4 | 1.07 |
| Crystalline polyester 6 | sebacic acid/ 76.0 | adipic acid/ 55.0 | 1,4-butanediol/ 69.0 | 1.04 |
| Crystalline polyester 7 | succinic acid 130.0 | — | ethylene glycol/ 70.0 | 1.07 |
| Crystalline polyester 8 | sebacic acid/ 138.0 | — | 1,4-butanediol/ 62.0 | 1.02 |

TABLE 2

| | Mn | Mw | Mw/Mn | Melting point (° C.) | ΔH (J/g) | Half-value width (° C.) |
|---|---|---|---|---|---|---|
| Crystalline polyester 1 | 4,900 | 11,300 | 2.3 | 66 | 118 | 3.6 |
| Crystalline polyester 2 | 5,000 | 11,500 | 2.3 | 61 | 112 | 3.5 |
| Crystalline polyester 3 | 4,900 | 10,800 | 2.2 | 74 | 123 | 3.8 |
| Crystalline polyester 4 | 5,100 | 11,200 | 2.2 | 58 | 113 | 3.6 |
| Crystalline polyester 5 | 4,900 | 10,800 | 2.2 | 83 | 113 | 3.4 |
| Crystalline polyester 6 | 5,000 | 10,500 | 2.1 | 50 | 120 | 3.6 |
| Crystalline polyester 7 | 5,800 | 12,400 | 2.1 | 89 | 109 | 3.8 |
| Crystalline polyester 8 | 12,200 | 58,600 | 4.8 | 65 | 120 | 5.1 |

Synthesis of Amorphous Resin 1

The following materials:

polyoxypropylene (2.2)-2,2-bis(4-hydroxyphenyl)propane: 30.0 parts by mass, polyoxyethylene (2.2)-2,2-bis(4-hydroxyphenyl)propane: 34.0 parts by mass, terephthalic acid: 30.0 parts by mass, fumaric acid: 6.0 parts by mass, and dibutyltin oxide: 0.1 parts by mass are charged in a heat dried two-necked flask with introducing nitrogen. The inside of the system is replaced by nitrogen through reduced pressure, followed by stirring at 215° C. for 5 hr. Subsequently, the temperature of the reaction mixture is gradually increased to 230° C. under reduced pressure while continuing the stirring, and the stirring is further continued at the same temperature for 2 hr. When the reaction mixture has become viscous, the reaction is terminated by air cooling to obtain amorphous polyester as amorphous resin 1. The obtained amorphous resin 1 has an Mn of 2200, an Mw of 9800, and a Tg of 60° C.

Synthesis of Amorphous Resin 2

The following materials:

polyoxypropylene (2.2)-2,2-bis(4-hydroxyphenyl)propane: 30.0 parts by mass,
polyoxyethylene (2.2)-2,2-bis(4-hydroxyphenyl)propane: 33.0 parts by mass,
terephthalic acid: 21.0 parts by mass,
trimellitic anhydride: 1.0 part by mass,
fumaric acid: 3.0 parts by mass,
dodecenylsuccinic acid: 12.0 parts by mass, and
dibutyltin oxide: 0.1 parts by mass are charged in a heat dried two-necked flask with introducing nitrogen. The inside of the system is replaced by nitrogen through reduced pressure, followed by stirring at 215° C. for 5 hr. Subsequently, the temperature of the reaction mixture is gradually increased to 230° C. under reduced pressure while continuing the stirring, and the stirring is further continued at the same temperature for 2 hr. When the reaction mixture has become viscous, the reaction is terminated by air cooling to obtain amorphous polyester as amorphous resin 2. The obtained amorphous resin 2 has an Mn of 7200, an Mw of 43000, and a Tg of 63° C.

Synthesis of Block Polymer 1

The following materials:

crystalline polyester 1: 210.0 parts by mass
xylylene diisocyanate (XDI): 56.0 parts by mass
cyclohexanedimethanol (CHDM): 34.0 parts by mass, and
tetrahydrofuran (THF): 300.0 parts by mass are charged in a reaction container equipped with a stirrer and a thermometer while performing nitrogen replacement. The mixture is heated to 50° C., and urethanation is performed over 15 hr, followed by addition of 3.0 parts by mass of salicylic acid serving as a modifier to modify the isocyanate terminal. The solvent, THF, is distilled away to obtain block polymer 1. The physical properties of block polymer 1 are shown in Table 4.

Synthesis of Block Polymers 2 to 8 and 10 to 12

Block polymers 2 to 8 and 10 to 12 are synthesized as in the synthesis of block polymer 1 except that the type and the amount of the polyester and amounts of XDI, CHDM, THF, and the modifier are changed to those shown in Table 3. The physical properties of the block polymers 2 to 8 and 10 to 12 are shown in Table 4.

Synthesis of Block Polymer 9

The following materials:

crystalline polyester 1: 185.0 parts by mass
amorphous resin 1: 115.0 parts by mass, and
dibutyltin oxide: 0.1 parts by mass are charged in a reaction container equipped with a stirrer and a thermometer while performing nitrogen replacement. The mixture is heated to 200° C., and esterification is performed over 5 hr to obtain block polymer 9. The physical properties of block polymer 9 are shown in Table 4.

Preparation of Block Polymer Dispersions 1 to 12

50.0 parts by mass of block polymer 1 is dissolved in 200.0 parts by mass of ethyl acetate, and 3.0 parts by mass of anionic surfactant (sodium dodecylbenzenesulfonate) and 200.0 parts by mass of deionized water are added thereto. The resulting mixture is heated to 40° C. and is stirred for 10 min at 8000 rpm with an emulsifier (ULTRA TURRAX T50, manufactured by IKA Japan K.K.), and then the ethyl acetate is removed by volatilization to obtain block polymer dispersion 1. Block polymer dispersions 2 to 12 are prepared as in block polymer dispersion 1 except that the black polymer is changed to block polymers 2 to 12, respectively. The dispersion diameter (median diameter of volume criteria: D50) of the block polymer in each of the obtained block polymer dispersions is shown in Table 4.

TABLE 3

| | Crystalline polyester | | | | | |
|---|---|---|---|---|---|---|
| | Type | Amount (part by mass) | XDI amount (part by mass) | CHDM amount (part by mass) | Salicylic acid amount (part by mass) | THF amount (part by mass) |
| Block polymer 1 | Crystalline polyester 1 | 210.0 | 56.0 | 34.0 | 3.0 | 300.0 |
| Block polymer 2 | Crystalline polyester 2 | 210.0 | 56.0 | 34.0 | 3.0 | 300.0 |
| Block polymer 3 | Crystalline polyester 3 | 210.0 | 56.0 | 34.0 | 3.0 | 300.0 |
| Block polymer 4 | Crystalline polyester 4 | 210.0 | 56.0 | 34.0 | 3.0 | 300.0 |
| Block polymer 5 | Crystalline polyester 5 | 210.0 | 56.0 | 34.0 | 3.0 | 300.0 |
| Block polymer 6 | Crystalline polyester 1 | 176.0 | 75.0 | 49.0 | 3.0 | 300.0 |
| Block polymer 7 | Crystalline polyester 1 | 234.0 | 43.0 | 21.0 | 3.0 | 300.0 |
| Block polymer 8 | Crystalline polyester 1 | 258.0 | 30.0 | 12.0 | 3.0 | 300.0 |
| Block polymer 9 | Crystalline polyester 1 | 185.0 | Used amorphous resin 1 | | | |
| Block polymer 10 | Crystalline polyester 6 | 210.0 | 56.0 | 34.0 | 3.0 | 300.0 |
| Block polymer 11 | Crystalline polyester 7 | 210.0 | 56.0 | 34.0 | 3.0 | 300.0 |

TABLE 3-continued

| | Crystalline polyester | | | | | |
|---|---|---|---|---|---|---|
| | Type | Amount (part by mass) | XDI amount (part by mass) | CHDM amount (part by mass) | Salicylic acid amount (part by mass) | THF amount (part by mass) |
| Block polymer 12 | Crystalline polyester 1 | 156.0 | 86.0 | 58.0 | 3.0 | 300.0 |

XDI: xylylene diisocyanate
CHDM: cyclohexanedimethanol
THF: tetrahydrofuran

TABLE 4

| | Rate of crystalline polyester (mass %) | Mn | Mw | Mw/Mn | Tp' (° C.) | Half-value width (° C.) | Median diameter D50 in dispersion (nm) |
|---|---|---|---|---|---|---|---|
| Block polymer 1 | 70 | 15,900 | 33,700 | 2.1 | 58 | 5.8 | 230 |
| Block polymer 2 | 70 | 15,200 | 33,000 | 2.2 | 53 | 5.6 | 220 |
| Block polymer 3 | 70 | 15,900 | 31,000 | 1.9 | 66 | 5.8 | 220 |
| Block polymer 4 | 70 | 14,400 | 31,000 | 2.2 | 50 | 5.7 | 230 |
| Block polymer 5 | 70 | 15,900 | 35,200 | 2.2 | 75 | 5.5 | 230 |
| Block polymer 6 | 59 | 13,200 | 28,700 | 2.2 | 58 | 5.8 | 240 |
| Block polymer 7 | 78 | 14,100 | 30,900 | 2.2 | 58 | 5.7 | 230 |
| Block polymer 8 | 86 | 12,700 | 28,400 | 2.2 | 58 | 5.6 | 220 |
| Block polymer 9 | 62 | 18,900 | 70,100 | 3.7 | 58 | 5.7 | 240 |
| Block polymer 10 | 70 | 15,300 | 34,500 | 2.3 | 42 | 5.7 | 230 |
| Block polymer 11 | 70 | 11,800 | 26,400 | 2.2 | 81 | 5.9 | 240 |
| Block polymer 12 | 52 | 13,100 | 29,200 | 2.2 | 58 | 5.5 | 220 |

Preparation of Crystalline Polyester Dispersion 1

Crystalline polyester dispersion 1 is prepared as in block polymer dispersion 1 using crystalline polyester 8 instead of block polymer 1.

Preparation of Amorphous Resin Dispersions 1 and 2

Amorphous resin dispersions 1 and 2 are prepared as in block polymer dispersion 1 using amorphous resin 1 and 2 instead of block polymer 1.

Preparation of Colorant Dispersion

The following materials:

C.I. Pigment Blue 15:3: 50.0 parts by mass cationic surfactant, NEOGEN RK (manufactured by Daiichi Kogyo Seiyaku Co., Ltd.): 5.0 parts by mass, and deionized water: 200.0 parts by mass are put into a heat-resistant glass container and are dispersed with a paint shaker for 5 hr. The glass beads are removed by filtration through nylon mesh to obtain a colorant dispersion having a median diameter (D50) of volume criteria of 220 nm and a solid content of 20 mass %.

Preparation of Wax Dispersion

The following materials:

paraffin wax HNP10 (melting point: 75° C., manufactured by Nippon Seiro Co., Ltd.): 30.0 parts by mass, cationic surfactant, NEOGEN RK (manufactured by Daiichi Kogyo Seiyaku Co., Ltd.): 5.0 parts by mass, and deionized water: 270.0 parts by mass are mixed, and the mixture is heated to 95° C. and is sufficiently dispersed with ULTRA TURRAX T50 (manufactured by IKA Japan K.K.) and then with a pressure discharge GAULIN HOMOGENIZER to obtain a wax dispersion having a median diameter (D50) of volume criteria of 200 nm and a solid content of 15 mass %.

Example 1

Production Process of Untreated Particles 1

The following materials:

block polymer dispersion 1: 375.0 parts by mass, colorant dispersion: 25.0 parts by mass, wax dispersion: 67.0 parts by mass, and aqueous solution of 10 mass % of aluminum polychloride: 1.5 parts by mass are mixed in a round stainless steel flask and are mixed and dispersed with ULTRA TURRAX T50 (manufactured by IKA Japan K.K.) and are then stirred at 45° C. for 60 min (aggregation step). Subsequently, 50 parts by mass of amorphous resin dispersion 2 is gradually added to the resulting dispersion, and the system is adjusted to a pH of 6 with an aqueous solution of 0.5 mol/L sodium hydroxide. Then, the stainless steel flask is sealed, and the dispersion is heated to 96° C. while continuing the stirring with a magnetic seal. During the temperature is being increased, an aqueous solution of sodium hydroxide is properly added to the dispersion to avoid a decrease of pH to below 5.5. Then, the dispersion is maintained at 96° C. for 5 hr (fusion step).

Then, after cooling, filtration, and sufficient washing with deionized water, solid-liquid separation is performed by Nutsche suction filtration. The solid matter is further re-dispersed in 3 L of deionized water and is stirred and washed at 300 rpm for 15 min. This procedure is repeated another five times, and when the pH of the filtrate has become 7.0, solid-liquid separation is performed by Nutsche suction filtration using filter No. 5A. The solid matter is vacuum dried for 12 hr to obtain untreated particles 1. In the measurement of endothermic amount of the obtained untreated particles 1 with a DSC, the peak temperature of the maximum endothermic peak is 58° C.

Annealing Treatment of Untreated Particles 1

Annealing treatment is performed using a thermostatic dryer (41-S5, manufactured by Satake Chemical Equipment MFG., Ltd.) having an internal temperature adjusted to 51° C.

Untreated particles 1 are uniformly spread on a stainless steel tray and are left to stand in the thermostatic dryer for 12.0 hr for annealing to obtain treated particles 1.

External Addition Step

To 100 parts by mass of treated particles 1, 1.8 parts by mass of hydrophobic silica fine particles treated with hexamethyldisilazane (number-average primary particle diameter: 7 nm) and 0.15 parts by mass of rutile-type titanium oxide fine particles (number-average primary particle diameter: 30 nm) were dry-mixed for 5 min with a HENSCHEL MIXER (manufactured by Mitsui Mining Co., Ltd.) to obtain toner 1. The physical properties of toner 1 are shown in Table 5.

Method of Evaluation

The following evaluations are performed. Table 6 shows the evaluation results.

Fixing Property

In formation of unfixed images, a printer LBP-5300 (manufactured by CANON KABUSHIKI KAISHA) from which the fixing unit is detached is used. LBP-5300 employs single-component contact development and is an apparatus that regulates the toner amount on an image support member by a toner-regulating member. The toner in a commercially available cartridge for LBP-5300 is extracted from the cartridge. The inside of the cartridge is cleaned by air blow, and the cartridge is filled with a toner to be evaluated and is used as the cartridge for evaluation. The cartridge for evaluation is left to stand under an ordinary temperature and ordinary humidity environment (23° C./60% RH) for 24 hr and is mounted on the cyan station of LBP-5300, and dummy cartridges are mounted on the other stations. Under this condition, an unfixed solid image (toner laid-on level: 0.6 mg/cm$^2$) having a width of 100 mm and a length of 280 mm is formed on plain paper for copying (64 g/m$^2$) with a leading edge margin of 5 mm.

The fixing unit is detached from the color laser printer and modified such that the fixing temperature can be controlled and is used for a fixation test. The specific method for evaluation is as follows.

Under an ordinary temperature and ordinary humidity environment (23° C., 60% RH), the process speed is set to 180 mm/s, and the initial temperature is set to 90° C., and fixation of the unfixed image is performed at each temperature increased in increments of 5° C. The lowest temperature that satisfies the following two conditions is defined as the lower temperature side of fixing-starting temperature:

(i) no low-temperature offset is recognized by visual observation, and (ii) when the obtained unfixed image is rubbed five times in both ways with lens-cleaning paper provided with a load of 4.9 kPa (50 g/cm$^2$), the reduction ratio in image density after the rubbing is 10% or less.

The image density is evaluated using a reflection densitometer (500 SERIES SPECTRODENSITOMETER) manufactured by X-rite, Inc.

In addition, the same measurement is performed using a cartridge stored under an environment of 40° C./95% RH for 30 days instead of the cartridge for evaluation left under an ordinary temperature and ordinary humidity environment.

Furthermore, the hot offset resistance is evaluated by defining the upper limit temperature that does not cause hot offset as the higher temperature side of fixing-possible temperature. As in the evaluation of the low-temperature fixability, an unfixed solid image (toner laid-on level: 0.2 mg/cm$^2$) having a width of 100 mm and a length of 20 mm is formed on plain paper for copying (64 g/m$^2$) with a leading edge margin of 5 mm using a printer LBP-5300 manufactured by CANON KABUSHIKI KAISHA at a monochromatic mode. Then, the process speed is set to 180 mm/s, and the initial temperature is set to 90° C., and fixation of an unfixed image is performed at each temperature increased in increments of 5° C. The obtained fixed image is evaluated whether or not high-temperature offset (a phenomenon that a fixed image on paper adheres to a fixing roller and the image re-adheres to paper by one revolution of the fixing roller) occurs. When the difference between the image density at a portion where offset occurred and the image density at the non-image portion is 0.05 times or more the density of the solid image, it is defined as the occurrence of hot offset. The highest temperature that is lower than the temperature at which hot offset occurred is defined as the higher temperature side of fixing-possible temperature. The image density is measured using a reflection densitometer (500 SERIES SPECTRODENSITOMETER, manufactured by X-rite, Inc.).

The fixing temperature range in Table 6 is a difference between the lower temperature side of fixing-starting temperature and the higher temperature side of fixing-possible temperature and denotes the extent of a fixable temperature region.

Heat-Resistant Storage Property

Two 100-mL cups, which made from resin, each containing about 10 g of toner are prepared and are left in thermostatic chambers adjusted at 52.5° C. and 55° C., respectively, for three days. Then, the conditions of the powder are visually observed and are evaluated by the following criteria:

A: no aggregates are recognized, and almost the same conditions as the initial are confirmed, B: aggregates are slightly observed, but are broken by lightly shaking the cup 5 times, and are not problems, C: there is a tendency of aggregating, but the aggregates can be readily broken with fingers, D: aggregates are strong and are not easily broken with fingers, and E: toner is solidified and cannot be used.

Image Density

As the apparatus for evaluating image density, a printer LBP-5300 manufactured by CANON KABUSHIKI KAISHA is used. As the cartridge, the toner in a commercially available cartridge for LBP-5300 is extracted from the cartridge, and the inside of the cartridge is cleaned by air blow, and the cartridge is filled with a toner to be evaluated and is mounted on the printer. As the transfer paper, Color Laser Copier paper (manufactured by CANON KABUSHIKI KAISHA) is used. Under these conditions, a fixed solid image with a toner laid-on level of 0.30 mg/cm$^2$ is formed and is used as a sample for initial evaluation. Furthermore, an image with a printing rate of 1% is output on 15000 sheets under an ordinary temperature and ordinary humidity environment of 23° C./60% RH, and then a fixed solid image with a toner laid-on level of 0.30 mg/cm$^2$ is formed again as a sample for durability evaluation. The image densities of the two images are measured using a reflection densitometer (500 SERIES SPECTRODENSITOMETER) manufactured by X-rite, Inc. The densities of randomly selected five points on each image are measured, and the average of three values excluding the maximum and minimum values is used for evaluation. In Table 6, the column "Initial" shows evaluation results when the sample for initial evaluation is used, and the column "After feeding 15000 sheets" shows evaluation results when the sample for durability evaluation is used.

Examples 2 to 8 and 10 to 18

Toners 2 to 8 and 10 to 18 are produced as in Example 1 except that the types of the block polymer dispersions and conditions of the annealing step are changed to those shown in Table 5. The physical properties and evaluation results of the obtained toners are shown in Tables 5 and 6, respectively.

Example 9

In the production process of untreated particles 1, when the pH has become 7.0, the temperature of the solution is increased to 51° C. while continuing the dispersing and stirring without performing solid-liquid separation, and the annealing treatment is performed in water for 24.0 hr. Subsequently, solid-liquid separation is performed by Nutsche suction filtration using filter No. 5A. The solid matter is vacuum dried for 12 hr to obtain treated particles 9. When the pH has become 7.0, a small amount of the particles are dried and subjected to endothermic amount measurement with a DSC to confirm that the peak temperature of the maximum endothermic peak is 58° C.

The obtained treated particles 9 are subjected to external addition treatment as in Example 1 to obtain toner 9. The physical properties and evaluation results of toner 9 are shown in Tables 5 and 6, respectively.

Comparative Example 1

Comparative untreated particles 1 are obtained as in the production process of untreated particles 1 using 149.0 parts by mass of crystalline polyester dispersion 1 and 226.0 parts by mass of amorphous resin dispersion 2 instead of 375.0 parts by mass of block polymer dispersion 1. The obtained comparative untreated particles 1 are subjected to external addition treatment as in Example 1, without performing annealing treatment, to obtain toner 19. The physical properties and evaluation results of toner 19 are shown in Tables 5 and 6, respectively.

Comparative Example 2

Comparative untreated particles 1 obtained in Comparative Example 1 are annealed as in Example 1 except that the annealing temperature is changed to 55° C. In the endothermic amount measurement of the comparative untreated particles 1 with a DSC, the peak temperature of the maximum endothermic peak is 62° C. The obtained treated particles are subjected to external addition treatment as in Example 1 to obtain toner 20. The physical properties and evaluation results of toner 20 are shown in Tables 5 and 6, respectively.

Comparative Example 3

Comparative untreated particles 3 are obtained as in the production process of untreated particles 1 using 268.0 parts by mass of crystalline polyester dispersion 1 and 107.0 parts by mass of amorphous resin dispersion 2 instead of 375.0 parts by mass of block polymer dispersion 1. The obtained comparative untreated particles 3 are annealed as in Example 1 except that the annealing temperature is changed to 55° C. In the measurement of endothermic amount of the comparative untreated particles 3 with a DSC, the peak temperature of the maximum endothermic peak is 62° C. The obtained treated particles are subjected to external addition treatment as in Example 1 to obtain toner 21. The physical properties and evaluation results of toner 21 are shown in Tables 5 and 6, respectively.

Comparative Example 4

Comparative untreated particles 4 are obtained as in the production process of untreated particles 1 using 150.0 parts by mass of block polymer dispersion 1, 157.0 parts by mass of crystalline polyester dispersion 1, and 68.0 parts by mass of amorphous resin dispersion 2 instead of 375.0 parts by mass of block polymer dispersion 1. The obtained comparative untreated particles 4 are annealed as in Example 1 except that the annealing temperature is changed to 55° C. In the measurement of endothermic amount of the comparative untreated particles 4 with a DSC, the peak temperature of the maximum endothermic peak is 62° C. The obtained treated particles are subjected to external addition treatment as in Example 1 to obtain toner 22. The physical properties and evaluation results of toner 22 are shown in Tables 5 and 6, respectively.

Comparative Example 5

Toner 23 is obtained as in Example 1 except that annealing treatment is not performed. The physical properties and evaluation results of toner 23 are shown in Tables 5 and 6, respectively.

Reference Examples 1 to 3 and 5 to 7

Toners 24 to 26 and 28 and 30 are obtained as in Example 1 except that the types of the block polymer dispersions and conditions of the annealing step are changed to those shown in Table 5. The physical properties and evaluation results of the obtained toners are shown in Tables 5 and 6, respectively.

Reference Example 4

Reference untreated particles 4 are obtained as in the production process of untreated particles 1 using 220.0 parts by mass of block polymer dispersion 8 and 155.0 parts by mass of crystalline polyester dispersion 1 instead of 375.0 parts by mass of block polymer dispersion 1. The obtained reference untreated particles 4 are annealed as in Example 1 except that the annealing temperature is changed to 51° C. In the measurement of endothermic amount of the reference untreated particles 4 with a DSC, the peak temperature of the maximum endothermic peak is 58° C. The obtained treated particles are subjected to external addition treatment as in Example 1 to obtain toner 27. The physical properties and evaluation results of toner 27 are shown in Tables 5 and 6, respectively.

TABLE 5

| | Block polymer dispersion | | Annealing treatment | | DSC properties | | | | Rate of portion capable of forming crystal structure to | | |
|---|---|---|---|---|---|---|---|---|---|---|---|
| | Type | Tp' (° C.) | Temperature (° C.) | Time (hr) | Tp (° C.) | ΔH (J/g) | Half-value width (° C.) | average sphericity | binder resin (mass %) | Mw | D4 (μm) |
| Example 1 | 1 | 58 | 51 | 12.0 | 61 | 43 | 2.7 | 0.965 | 63 | 36,100 | 5.5 |
| Example 2 | 2 | 53 | 46 | 12.0 | 56 | 43 | 2.8 | 0.968 | 63 | 35,800 | 5.3 |
| Example 3 | 3 | 66 | 59 | 12.0 | 69 | 43 | 2.8 | 0.964 | 63 | 34,500 | 5.4 |
| Example 4 | 4 | 50 | 43 | 12.0 | 53 | 43 | 2.7 | 0.970 | 63 | 34,600 | 5.6 |
| Example 5 | 5 | 75 | 68 | 12.0 | 78 | 43 | 2.8 | 0.963 | 63 | 37,100 | 5.5 |
| Example 6 | 6 | 58 | 51 | 12.0 | 61 | 35 | 2.9 | 0.965 | 52 | 33,300 | 5.5 |
| Example 7 | 7 | 58 | 51 | 12.0 | 61 | 78 | 3.0 | 0.966 | 69 | 33,800 | 5.4 |

TABLE 5-continued

| | Block polymer dispersion | | Annealing treatment | | DSC properties | | | | Rate of portion capable of forming crystal structure to | | |
|---|---|---|---|---|---|---|---|---|---|---|---|
| | Type | Tp' (° C.) | Temperature (° C.) | Time (hr) | Tp (° C.) | ΔH (J/g) | Half-value width (° C.) | average sphericity | binder resin (mass %) | Mw | D4 (μm) |
| Example 8 | 8 | 58 | 51 | 12.0 | 61 | 84 | 3.0 | 0.968 | 76 | 32,900 | 5.6 |
| Example 9 | 1 | 58 | 51 | 24.0 | 60 | 42 | 3.6 | 0.967 | 63 | 36,000 | 5.4 |
| Example 10 | 1 | 58 | 44 | 12.0 | 60 | 44 | 4.9 | 0.966 | 63 | 36,100 | 5.8 |
| Example 11 | 1 | 58 | 53 | 12.0 | 61 | 38 | 2.9 | 0.959 | 63 | 36,200 | 5.6 |
| Example 12 | 1 | 58 | 44 | 6.0 | 59 | 45 | 5.3 | 0.964 | 63 | 36,100 | 5.7 |
| Example 13 | 1 | 58 | 51 | 24.0 | 61 | 42 | 2.7 | 0.969 | 63 | 36,100 | 5.5 |
| Example 14 | 1 | 58 | 51 | 48.0 | 61 | 42 | 2.7 | 0.966 | 63 | 36,000 | 5.3 |
| Example 15 | 1 | 58 | 51 | 1.2 | 59 | 44 | 4.2 | 0.967 | 63 | 36,100 | 5.4 |
| Example 16 | 1 | 58 | 51 | 0.6 | 59 | 45 | 4.5 | 0.963 | 63 | 36,200 | 5.5 |
| Example 17 | 1 | 58 | 44 | 0.6 | 59 | 46 | 5.4 | 0.966 | 63 | 36,100 | 5.8 |
| Example 18 | 9 | 58 | 51 | 12.0 | 61 | 38 | 2.8 | 0.964 | 55 | 59,000 | 5.6 |
| Comparative Example 1 | (*1) | (65) | — | — | 62 | 25 | 6.2 | 0.962 | 35 | 56100 | 5.5 |
| Comparative Example 2 | (*1) | (65) | 55 | 12.0 | 65 | 25 | 3.2 | 0.960 | 35 | 56000 | 5.6 |
| Comparative Example 3 | (*1) | (65) | 55 | 12.0 | 65 | 46 | 3.5 | 0.959 | 63 | 40,500 | 5,6 |
| Comparative Example 4 | 1, (*1) | (65) | 55 | 12.0 | 65 | 42 | 2.9 | 0.961 | 63 | 37300 | 5.8 |
| Comparative Example 5 | 1 | 58 | — | — | 58 | 46 | 6.0 | 0.963 | 63 | 36,200 | 5.3 |
| Reference Example 1 | 10 | 42 | 36 | 12.0 | 45 | 42 | 2.8 | 0.970 | 63 | 37,100 | 5.6 |
| Reference Example 2 | 11 | 81 | 74 | 12.0 | 83 | 42 | 2.9 | 0.966 | 63 | 36,500 | 5.7 |
| Reference Example 3 | 12 | 58 | 51 | 12.0 | 61 | 26 | 2.6 | 0.968 | 42 | 33,900 | 5.8 |
| Reference Example 4 | 8, (*1) | 58 | 51 | 12.0 | 61 | 89 | 3.0 | 0.969 | 81 | 33,600 | 5.5 |
| Reference Example 5 | 1 | 58 | 42 | 12.0 | 58 | 45 | 5.5 | 0.964 | 63 | 36,000 | 5.4 |
| Reference Example 6 | 1 | 58 | 54 | 12.0 | 61 | 36 | 2.8 | 0.961 | 63 | 36,100 | 5.8 |
| Reference Example 7 | 1 | 58 | 51 | 0.3 | 58 | 45 | 5.1 | 0.966 | 63 | 36,200 | 5.5 |

In Table 5, (*1) represents that crystalline polyester dispersion 1 was used.

TABLE 6

| | Fixing properties | | | | | | | | | |
|---|---|---|---|---|---|---|---|---|---|---|
| | After storage at ordinary temperature and ordinary humidity for 24 hr | | | After storage at 40° C. and 95% RH for 30 days | | | Heat-resistant storage property | | Image density | |
| | Lower temperature side of fixing-starting temperature (° C.) | Higher temperature side of fixing-possible temperature (° C.) | Fixing temperature range (° C.) | Lower temperature side of fixing-starting temperature (° C.) | Higher temperature side of fixing-possible temperature (° C.) | Fixing temperature range (° C.) | 52.5° C. | 55° C. | Initial | After feeding 15000 sheets |
| Example 1 | 100 | 160 | 60 | 100 | 160 | 60 | A | A | 1.55 | 1.55 |
| Example 2 | 100 | 150 | 50 | 100 | 150 | 50 | A | B | 1.54 | 1.53 |
| Example 3 | 110 | 160 | 50 | 110 | 160 | 50 | A | A | 1.55 | 1.54 |
| Example 4 | 90 | 140 | 50 | 90 | 140 | 50 | B | C | 1.54 | 1.53 |
| Example 5 | 120 | 170 | 50 | 120 | 170 | 50 | A | A | 1.55 | 1.54 |
| Example 6 | 110 | 160 | 50 | 110 | 160 | 50 | A | A | 1.56 | 1.55 |
| Example 7 | 100 | 135 | 35 | 100 | 135 | 35 | A | A | 1.46 | 1.45 |
| Example 8 | 100 | 130 | 30 | 100 | 130 | 30 | A | A | 1.42 | 1.41 |
| Example 9 | 100 | 160 | 60 | 100 | 160 | 60 | A | A | 1.52 | 1.47 |
| Example 10 | 100 | 160 | 60 | 105 | 160 | 55 | A | B | 1.53 | 1.48 |
| Example 12 | 100 | 160 | 60 | 105 | 160 | 55 | A | C | 1.54 | 1.43 |
| Example 13 | 100 | 160 | 60 | 100 | 160 | 60 | A | A | 1.54 | 1.53 |
| Example 14 | 100 | 160 | 60 | 100 | 160 | 60 | A | A | 1.55 | 1.54 |
| Example 15 | 100 | 160 | 60 | 105 | 160 | 55 | A | B | 1.53 | 1.48 |
| Example 16 | 100 | 160 | 60 | 110 | 160 | 50 | A | B | 1.52 | 1.48 |
| Example 17 | 100 | 160 | 60 | 110 | 160 | 50 | A | C | 1.52 | 1.41 |

TABLE 6-continued

| | Fixing properties | | | | | | | | | |
|---|---|---|---|---|---|---|---|---|---|---|
| | After storage at ordinary temperature and ordinary humidity for 24 hr | | | After storage at 40° C. and 95% RH for 30 days | | | | | | |
| | Lower temperature side of fixing-starting temperature (° C.) | Higher temperature side of fixing-possible temperature (° C.) | Fixing temperature range (° C.) | Lower temperature side of fixing-starting temperature (° C.) | Higher temperature side of fixing-possible temperature (° C.) | Fixing temperature range (° C.) | Heat-resistant storage property 52.5° C. | Heat-resistant storage property 55° C. | Image density Initial | Image density After feeding 15000 sheets |
| Example 18 | 105 | 135 | 30 | 105 | 135 | 30 | A | B | 1.53 | 1.53 |
| Comparative Example 1 | 120 | 130 | 10 | 130 | 130 | 0 | A | B | 1.47 | 1.32 |
| Comparative Example 2 | 120 | 130 | 10 | 120 | 130 | 10 | A | B | 1.46 | 1.38 |
| Comparative Example 3 | 100 | 100 | 0 | 100 | 100 | 0 | A | B | 1.54 | 1.31 |
| Comparative Example 4 | 100 | 120 | 20 | 100 | 120 | 20 | A | B | 1.52 | 1.36 |
| Comparative Example 5 | 100 | 160 | 60 | 120 | 160 | 40 | B | D | 1.54 | 1.34 |
| Reference Example 1 | 90 | 130 | 40 | 90 | 130 | 40 | D | E | 1.51 | 1.49 |
| Reference Example 2 | 130 | 160 | 30 | 130 | 160 | 30 | A | A | 1.53 | 1.53 |
| Reference Example 3 | 130 | 150 | 20 | 130 | 150 | 20 | A | A | 1.54 | 1.53 |
| Reference Example 4 | 100 | 120 | 20 | 100 | 130 | 30 | A | A | 1.42 | 1.33 |
| Reference Example 5 | 100 | 160 | 60 | 115 | 160 | 45 | B | D | 1.51 | 1.41 |
| Reference Example 6 | 100 | 160 | 60 | 110 | 160 | 50 | B | D | 1.53 | 1.44 |
| Reference Example 7 | 100 | 160 | 60 | 115 | 160 | 45 | A | D | 1.52 | 1.39 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-269739, filed Dec. 2, 2010, which is hereby incorporated by reference herein in its entirety.

The invention claimed is:

1. A process for producing a toner containing toner particles by emulsion aggregation, comprising:

preparing aggregation particles by aggregating resin particles, colorant particles, and wax particles in a state dispersed in an aqueous medium; and fusing the aggregation particles to form fused particles, wherein each toner particle includes a binder resin of which a main component is a block polymer having a crystal structure, a colorant, and a release agent;

the binder resin includes polyester as a main component;

the rate of a portion capable of forming a crystal structure to the binder resin is 50 mass % or more and 80 mass % or less;

a peak temperature Tp of a maximum endothermic peak attributed to the binder resin is 50° C. or more and 80° C. or less in endothermic amount measurement of the toner with a differential scanning calorimeter (DSC); and the process further comprises heating the fused particles at a heating temperature t (° C.) satisfying the following expression (1):

$$Tp'-15.0 \leq t \leq Tp'-5.0 \quad (1)$$

(in the expression, Tp' represents the peak temperature of the maximum endothermic peak of the block polymer in the endothermic amount measurement with a DSC) for at least 0.5 hr, wherein the block polymer has a portion capable of forming a crystal structure and a portion not forming a crystal structure that are linked to each other with a urethane bond.

2. The process according to claim 1, wherein the heating time for heating the particles is 1.0 hr or more and 50.0 hr or less.

3. The process according to claim 1, wherein the total endothermic amount (ΔH) of the endothermic peak attributed to the binder resin is 30 J/g or more and 80 J/g or less per 1 g of the binder resin, when determined by endothermic amount measurement of the toner with a DSC.

4. The process according to claim 1, wherein a half-value width of an endothermic peak attributed to the binder resin is 5.0° C. or less.

* * * * *